United States Patent [19]

Munro et al.

[11] Patent Number: 4,475,693

[45] Date of Patent: Oct. 9, 1984

[54] METHOD OF PRODUCING GLASS FIBER PRODUCT

[75] Inventors: Alexander Munro, Atherton; Lester Entwisle, Hindley Green, both of England

[73] Assignee: TBA Industrial Products Limited, Manchester, England

[21] Appl. No.: 424,305

[22] Filed: Sep. 27, 1982

Related U.S. Application Data

[63] Continuation-in-part of Ser. No. 275,384, Jun. 19, 1981, abandoned.

[30] Foreign Application Priority Data

Jun. 15, 1981 [GB] United Kingdom ..... 8118358

[51] Int. Cl.[3] ..... B65H 54/00; B65H 55/04

[52] U.S. Cl. ..... 242/42; 242/159; 57/350; 28/274

[58] Field of Search ..... 242/42, 159; 57/244, 57/350, 908; 28/272, 274, 275, 276

[56] References Cited

U.S. PATENT DOCUMENTS

| | | | |
|---|---|---|---|
| 2,985,995 | 5/1961 | Bunting, Jr. et al. | 57/350 X |
| 3,249,312 | 5/1966 | Current | 242/42 |
| 3,361,375 | 1/1968 | Klink et al. | 242/42 |
| 3,364,537 | 1/1968 | Bunting, Jr. et al. | 28/272 |
| 4,074,871 | 2/1978 | Stotler | 242/42 |
| 4,147,020 | 4/1979 | Oakes | 28/274 |

FOREIGN PATENT DOCUMENTS

| | | | |
|---|---|---|---|
| 139846 | 12/1978 | Japan | 28/274 |

*Primary Examiner*—Stanley N. Gilreath
*Attorney, Agent, or Firm*—Cushman, Darby & Cushman

[57] ABSTRACT

Continuous multifilament glass fiber roving of from 300 to 10,000 tex is rendered catenary-free without twisted by passing it at from 150 to 300 meters/minute through an air treatment zone in which it is exposed to air at from 400 to 600 KN/meter$^2$ at a volume throughput of from 0.5 to 1.5 cubic meters/minute, the air treatment being carried out in the absence of positive overfeed whereby there is no bulking of the roving, followed by winding the treated roving into a package.

3 Claims, 9 Drawing Figures

Figure 5:
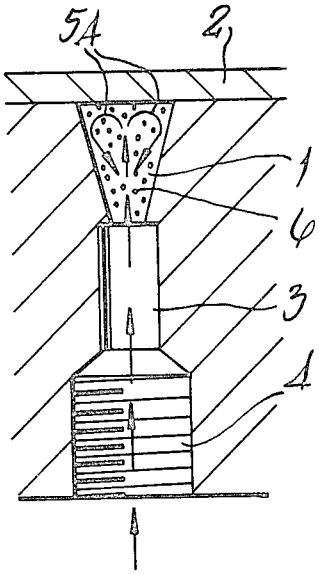

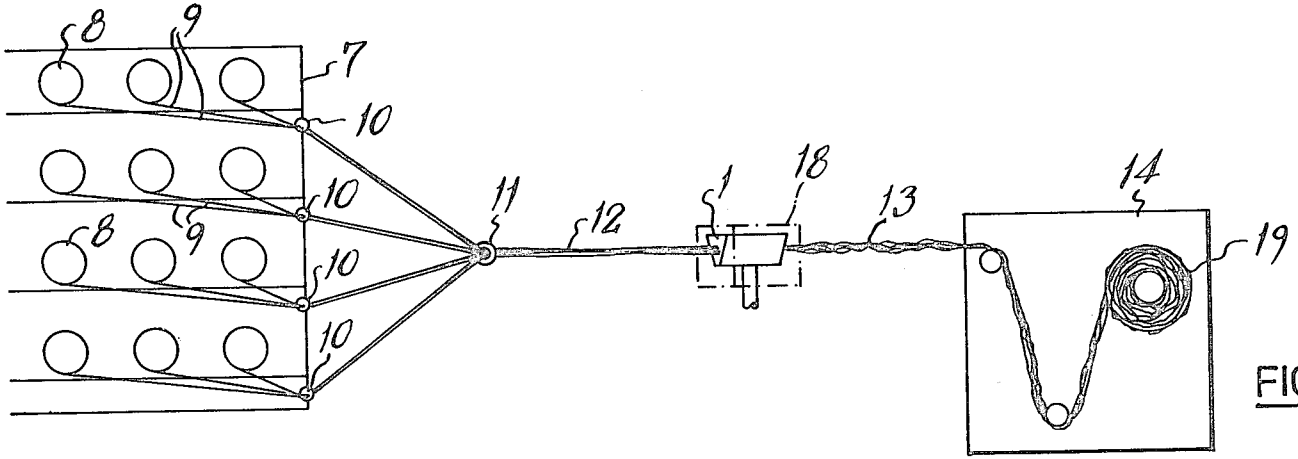
FIG.1
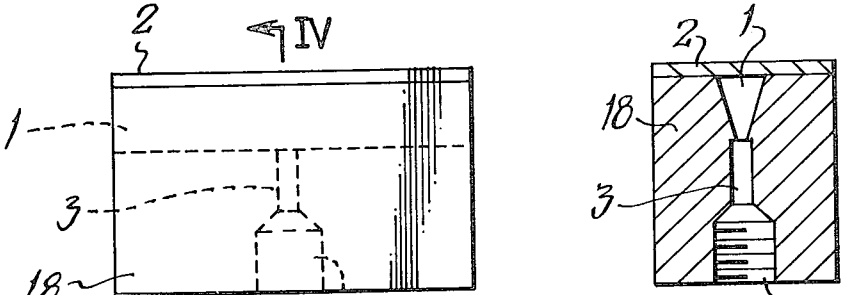
FIG.3
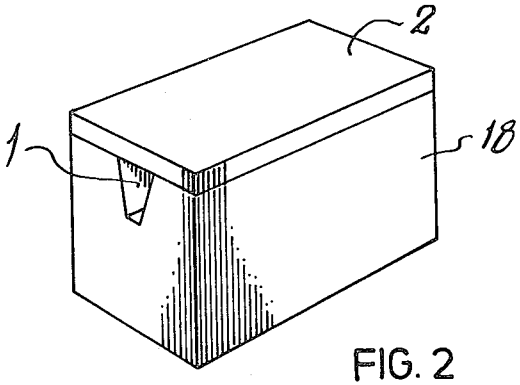
FIG.2
FIG.4

METHOD OF PRODUCING GLASS FIBER PRODUCT

This application is a continuation-in-part of our copending application Ser. No. 275,384 filed June 19, 1981, now abandoned.

This invention relates to the processing of continuous glass filaments and in particular it is concerned with the preparation of heavy rovings from strands comprised of such filaments for conversion into fabrics by weaving and for use in the reinforcement of plastics, especially by the pultrusion process.

Heavy rovings in this present context are very different in behaviour and physical characteristics from apparel yarns. They have linear densities in the range 300 to at least 10,000 tex or from 2,700 to 90,000 denier. For many conventional textile purposes they are tows, although they are more commonly referred to as rovings in the fiber glass industry.

A well-known problem in the preparation of such rovings is the phenomenon sometimes known as "catenary". This is the lateral separation of individual strands from an untwisted roving made up of a bundle of such strands. It is caused by variations in tension present in the individual reel packages which are unwound and assembled side-by-side together to form the roving. "Catenary" gives rise to problems in further processing and in the final conversion of the roving; various methods are known for minimising its effect. These methods include sizing treatments and twisting processes, both of which give the desired cohesion, but at the expense of processing properties or the use of an extra process step, respectively.

It is known that relatively fine, zero twist or "producer twist" filament strands can be converted into compact, coherent yarns suitable for apparel use by subjecting them to treatment by a fluid stream, whilst under controlled, positive tension. The specification of U.S. Pat. No. 2,985,995 discloses such a process.

However, it has not been suggested that this process may be applied to heavy continuous filament glass fiber rovings (tows) and indeed at the prescribed tension levels of 0.09 to 5.85 gm/tex (0.01 to 0.065 gm/denier) the process is ineffective for such rovings. In any case, the very tightly bound compact and coherent yarns produced by said process are unsuitable either for plastics reinforcement or for weaving into fabrics of high cover factor.

According to the present invention, a method of producing an essentially catenary—free untwisted continuous multifilament glass fibre roving comprises the steps of withdrawing individual continuous multifilament glass fibre strands from each of a plurality of creel packages, assembling them side-by-side to form a single roving of linear density 300 to 10,000 tex (2,700 to 90,000 denier,) passing said roving at from 150 to 300 meters/minute through an air treatment zone comprising a relatively confined passageway into which air is introduced generally normally with respect to the direction of travel of the rovings, said air being at a pressure on the order of 400 to 600 KN/meter$^2$ (60 to 75 psi) at at a volume throughput of 0.5 to 1.5 cubic meters/min (2 to 5 cubic ft/min), said air treatment being carried out in the absence of positive overfeed, whereby there is no bulking of the roving, followed by winding the treated roving into a package.

It has been found that relatively small air pressures and volume throughputs are highly effective to produce an essentially catenary-free roving, even with roving linear densities of from 300 to 10,000 tex and at strand throughputs in the range 150–300 meters/minute. Low air pressures of the order of 400 to 600 KN/meter$^2$ and air volume throughputs of 0.5 to 1.5 cubic meters/minute are effective; these are much less than would be used in conventional prior art jet texturing processes. The present process has some similarly to the so-called co-mingling process, but the latter has hitherto been used for moderate texturing (bulking) of relatively fine manmade fiber yarns, in conjuction with heating to "set" the bulk developed. A degree of positive overfeed is used in such processes to ensure that such bulking is achieved.

By contrast, the present process when applied to a very much coarser glass fiber roving in the complete absence of positive overfeed results in a roving which is not bulked, but essentially free from catenary. If the throughput is reduced towards 150 meters/minute, the product exhibits an apparent bulk. This bulk is only apparent, in the sense that on applying even moderate tension to the roving, it exhibits minimal or even zero extensibility, coupled with practically no change in its catenary properties. This type of product has been found to be valuable for use as a plastics reinforcement, particularly in pultrusion processes.

At roving throughputs of the order of 300 meters/minute the product is catenary-free and useful as a weaving grade roving. The fact that it is not compact or particularly coherent is a positive benefit in that it gives a better cover factor than would a conventional spun twisted roving.

A particularly advantageous aspect of the invention lies in the fact that both of the two specific roving products just described can be made by incorporating a very simple air treatment zone into the normal creel-to-package winding operation, without introducing any separate extra processing step. Conventional bulking apparatus is not needed.

A typical air treatment zone for present purposes comprises a V-shaped trough with a hinged lid clampable in sealing relation thereto. A trough about 2.5 cm long about 0.5 cm deep and of uniform cross-section has been found satisfactory, the airflow being introduced half way along the trough through an aperture about 0.25 cm in diameter, in the bottom of the V generally normal to the major axis of the trough and to the roving under treatment. Obviously, the precise geometry of the air treatment zone may be varied and some experimentation may be necessary in order to arrive at the optimum conditions for a particular roving and its throughput. In particular, the degree of tangling and the amount of apparent bulk (if any) developed can be varied within sensibly wide limits whilst still achieving the desired catenary-free characteristic.

Figure 6:
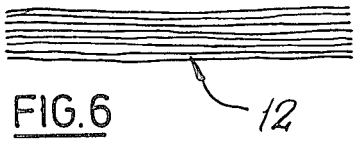
Figure 7:
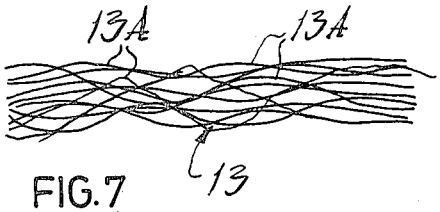
Figure 8:
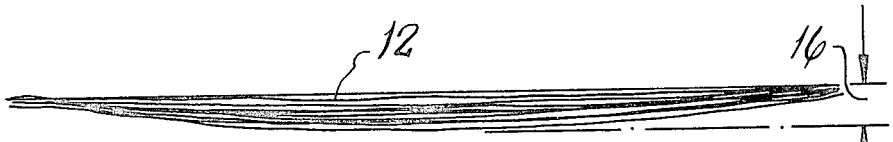
Figure 9:
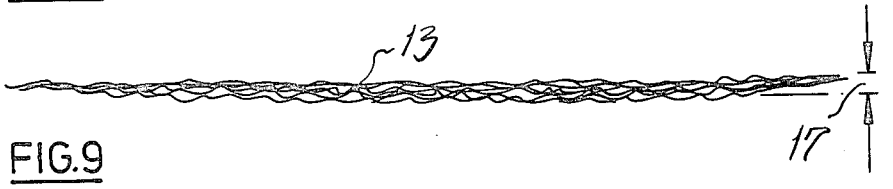

In order that the invention be better understood a preferred embodiment of it will now be described by way of example with reference to the accompanying drawings, in which:

FIG. 1 is a schematic side elevation of a glass fiber winding station including the air treatment zone of this invention, FIG. 2 is a perspective view of the apparatus constituting the treatment zone of FIG. 1, FIG. 3 is a side view of the apparatus of FIG. 2, FIG. 4 is a cross-sectional end view taken on line IV—IV of FIG. 3, FIG. 5 is an enlarged view of parts of FIG. 4, FIG. 6 is a representation of a length of roving prior to treatment in the air treatment zone of FIG. 1, FIG. 7 is a representation of the roving of FIG. 6 immediately after treatment in the air treatment zone, FIG. 8 illustrates the extent of catenary normally encountered with a roving of the FIG. 6 kind, and FIG. 9 illustrates the caternary to be expected in the treated roving of FIG. 7.

Before embarking on a detailed discussion of the Figures it is appropriate to outline the criteria used in assessing "catenary" in glass fiber rovings. Normal coherency tests, such as the hook drop test, are clearly inappropriate for a relatively coarse, heavy roving which is neither compact nor highly coherent. The empirical test developed by the applicants for determining catenary is based on examining a sample length of roving under standard conditions. In the test, roving is pulled off a package mounted on a turntable; the free end of the roving is anchored below a horizontal bar around and from which the roving is run horizontally for 15 meters (nearly 50 feet) to a similar bar. The roving passes over this bar, a 500 gm (11*b*) weight being hung on the end to tension the 15 meter length in a substantially horizontal state between the bars. Starting at the opposite (or anchorage) end, the individual filament any bundles are teased apart manually. Untreated roving will generally separate (in the manner of FIG. 8) but satisfactorily treated roving should not be separable to any really significant extent (FIG. 9). The "drop" of individual filamentary bundles relative to the tightest bundle is measured with a ruler.

A typical, untreated roving will exhibit a catenary (drop) of 15 cm over a 15 meter length, whereas a treated roving will have no more than 2 or 3 cm catenary, over the same length and will not be separable into individual bundles over that length.

Referring now to FIG. 1, a creel frame 7 carries a plurality of creel packages 8. These are conventional; each comprises a cylindrical cardboard former onto which some of the filamentary output of one fiber production bushing has been wound. These creel packages are hung on the frame and the filamentary bundle (9) from each package is withdrawn over-end to one of a plurality of thread guides 10 and thence to a combining guide 11. At this point the bundles become a heavy roving (tow) 12. Because no attempt is made to control the individual draw-off tensions, this roving would exhibit a FIG. 8 catenary characteristic if tested by the method described above. It is simply a side-by-side assembly of a lot of multi-filament bundles, only a few of which are shown in FIG. 1.

The roving 12 passes through an air treatment zone 1, after which it is wound (as treated roving 13) by a conventional cheese winder 14. The latter provides the whole of the motive power for the process; there is no intermediate winder as would be the case if overfeed were to be used for a bulking process.

The air treatment zone 1 comprises a V-section trough 1 (FIG. 2) extending through a box 18 which is provided with a lid 2. The roving is drawn through the trough, from one end of the box to the other.

FIGS. 3, 4 and 5 show the very simple internal construction of the box. An air inlet 3 is located about half way along the trough 1, and is connected to a compressed air source (not shown) through a pipe (not shown) screwed into a threaded union portion 4. The airstream (5 in FIG. 5) is directed normally of the roving filament bundles 6 and causes a swirling action 5A in the air treatment zone 1. Exhaust air escapes through the open ends of the trough. The apparatus is thus extremely simple.

The treated roving 13 is wound into a cheese 19 by the winder 14. On subjecting it to the same catenary test as the untreated roving 12 (FIG. 8) the result is as typified by FIG. 9, the two different catenary values being indicated at 16 and 17 respectively. Despite the relative simplicity of the treatment, the wound product 13 was suitable for direct processing into pultruded products exhibiting excellent transverse strength. It was also useful (not necessarily at the same tex value) for weaving into cloth having a good cover factor.

The apparatus just described is extremely adaptable and easy to use. For example, five creel packages each of 60 tex continuous multifilament glass fibers were used to make a 300 tex roving. The winding speed (the rate of withdrawal from the creel or the processing speed) was 300 meters/minute. The air pressure was set at 400 $KN/m^2$ (60 psi). A very satisfactory weaving material resulted. By using three 150 tex creel packages under exactly the same conditions, a 450 tex weaving roving was made, once again very satisfactorily and without any conventional twisting/doubling operations. The throughput of air was about 0.5 cubic meters/minute.

By contrast, 30 creel packages each of 300 tex were combined to make a 9000 tex roving. In this case the winding speed was reduced to 150 meters/minute and the air pressure was increased to 600 $KN/m^2$ (75 psi). The product was a very heavy roving which proved to be an excellent reinforcement for use in the pultrusion process. By increasing the number of creel packages to 33, a 9900 tex roving was made without further changes in speed or air pressure. Once again, the product was eminently suitable for use as a pultrusion reinforcement. In both cases, the pultruded products exhibited excellent transverse strength. In this case the air throughput was somewhat higher, at around 1.5 cubic meters/minute.

We claim:

1. A method of producing an essentially catenary-free, untwisted, continuous multifilament glass fiber roving, the method comprising the successive steps of:

(1) withdrawing individual continuous multifilament glass fiber strands from each of a plurality of creel packages;

(2) assembling them side-by-side to form a single roving of linear density 300 to 10,000 tex;

(3) passing said roving at a rate of from 150 to 300 meters/minute without positive overfeed, whereby there is no bulking thereof, through a relatively confined air treatment passageway;

(4) introducing air into said passageway generally normally with respect to the direction of passage of the roving at 0.5 to 1.5 cubic meters/minute under a pessure of from 400 to 600 $KN/meter^2$, followed by, (5) winding the thus treated roving into a package.

2. The method of claim 1 including the steps of:

passing said roving through an open-end V-shaped trough which is in use closed by a lid to define said relatively confined air treatment passageway; and introducing air through an aperture in the base of the V located approximately halfway between the ends of the trough.

3. The method of claim 1 including the step of:

the final package winding step providing all the motive power for the withdrawing, assembly and passing said roving through said air treatment passageway steps.

* * * * *